United States Patent [19]

Bense

[11] 4,009,839

[45] Mar. 1, 1977

[54] WINDING APPARATUS

[75] Inventor: William Malcolm Bense, Barrington, R.I.

[73] Assignee: Leesona Corporation, Warwick, R.I.

[22] Filed: Oct. 6, 1975

[21] Appl. No.: 620,173

[52] U.S. Cl. ..... 242/18 DD

[51] Int. Cl.[2] ..... B65H 54/42

[58] Field of Search ..... 242/18 R, 18 A, 18 DD, 242/25 A

[56] References Cited

UNITED STATES PATENTS

| | | | |
|---|---|---|---|
| 3,355,116 | 11/1967 | Conrad | 242/18 DD |
| 3,575,357 | 4/1971 | Enneking | 242/18 DD |
| 3,777,995 | 12/1973 | Funaiolli et al. | 242/18 DD |
| 3,841,574 | 10/1974 | Lenk et al. | 242/18 DD |
| 3,901,456 | 8/1975 | Pradier | 242/18 A |
| 3,937,409 | 2/1976 | Muller | 242/18 R |

*Primary Examiner*—John Petrakes
*Attorney, Agent, or Firm*—Burnett W. Norton

[57] ABSTRACT

This application relates to an apparatus for winding strandular material known in the textile industry as a takeup device. The overall arrangement of the device incorporates a stationary supporting spindle onto which a rotatable package support is mounted for receipt of strandular material wound thereon. The support and the strandular material wound thereon as the package is progressively built, is adapted for contact with a rotatable drive drum. A traverse device to guide the strandular material to the rotatable package and control the manner in which the strandular material is wound thereon is also included. Both the drive means and the traverse means including the motors therefor are mounted on a freely vertical movable carriage supported within a frame member and uniquely counterbalanced by a pulley suspended counterweight system. The spindle and the package support are mounted on said frame independent of such carriage. The drive and traverse means are thus free to move upwardly while the package progressively builds on the stationary spindle. Initial pressure means are further included to apply an initially higher pressure between the drive means and the package support to prevent skidding during the required acceleration of the support to its operational winding speed. Additionally, differential pressure means are included to progressively decrease the amount of drive pressure between the drive drum and the package as the package builds.

13 Claims, 5 Drawing Figures

WINDING APPARATUS

BACKGROUND OF THE INVENTION

Especially when winding heavy weight packages at the high rates of speed which is required for efficiency of operation in many modern textile producing facilities, it is desirable to provide a rotatable spindle which is otherwise fixed in position and onto which a surface driven tube or other package support is secured. The tube is rotated by means such as a drive roll contacting the tube surface directly and thereafter the strandular material wound thereon to thus wind an advancing strand of yarn or the like into a package. Suitable strand traversing means are also provided to distribute the strand from end to end of the package support and the previous strand layers of the package built thereon. Such traversing and drive means are conventionally mounted on some common means which permits their relative movement away from the package supporting spindle as the package wound thereon builds in diameter. In this manner the need to support a member which increasingly assumes a greater weight as the package winds with the necessary rigidity to prevent undesirable vibrational movement and the like is eliminated.

However, such a configuration requires that the means for carrying the traversing and drive means ie. the carriage means, be exceedingly sensitive to pressure applied thereto by the progressive winding of the strand upon the package support as the package progressively grows in diameter. Several devices presently available and which use pneumatic or mechanical linkages to support such carriage means have been found to introduce irregularities into the package produced by slight but abrupt changes in winding tension in turn caused by slight inconsistent upward movements in the carriage means. Thus in systems utilizing a pneumatic carriage with a supporting piston, pressure within the piston must build up to a finite point to overcome the inherent friction of its cylinder wall contact and when that point is reached the carriage jumps ahead a distance determined by the progressive package building action. Although such sequential pressure buildup and release produces very slight movements in the upward travel of the carriage, the movements are nevertheless abrupt and thus undesirable. Similar undesirable abrupt movements are introduced by the mechanical systems presently known.

Through emperical determinations, the present applicant has further found that it is desirable when winding packages of the type under consideration, that the introduction of a slight lessening of the driving force between the drive means and package as the package builds in diameter produces desirable package characteristics.

The present invention is thus directed to a winding apparatus which accomplishes the above indicated objectives while eliminating the above indicated shortcomings of prior art devices by the provision of a winding apparatus including a fixed position rotatable spindle adapted to receive a package support thereon and rotatable therewith. Strand traversing means for guiding the strand onto the support and drive means including a rotating drum for contacting the surface of the support and thereafter the strand surface as the package is progressively built to rotate the support and package mounted thereon is further included. Both the strand traversing and drive means are mounted on a carriage supported for free vertical movement towards and away from the independently supported fixed position spindle. An initial weight to at least partially counterbalance the combined weight of the carriage and the strand traversing and drive means mounted thereon is suspended from a common frame by means of a cable and pulley system so that pressure transmitted to the drive means as the package progressively builds on its support is freely and without variation transmitted smoothly to the carriage so as to enable a smooth unimpeded upon travel thereof. Such initial weight means places a minimum constant driving force on the package which is augmented by a differential pressure means which initially places an additive driving force on the package and thereafter gradually reduces such additive driving force as the package progressively builds.

With the foregoing in mind, it is a principal object of the present invention to provide a new and improved winding apparatus capable of winding an advancing strand at high speeds into heavy weight packages without undesirable pressure variations being introduced in the resultant package.

Another object of the present invention is to provide a winding apparatus including a counterweight means which permits smooth unhesitant upward movement of a traverse and drive means supporting carriage.

Still another object of the present invention is to provide a winding apparatus which enables the pressure or relative tightness of the package formed thereby to be varied during the building thereof by the incorporation of a differential pressure means for gradually reducing the driving force on said package as the package builds.

Other objects of the invention will appear in the following descriptive portions of the subject specification.

DESCRIPTION OF THE PREFERRED EMBODIMENT

Figure 5:
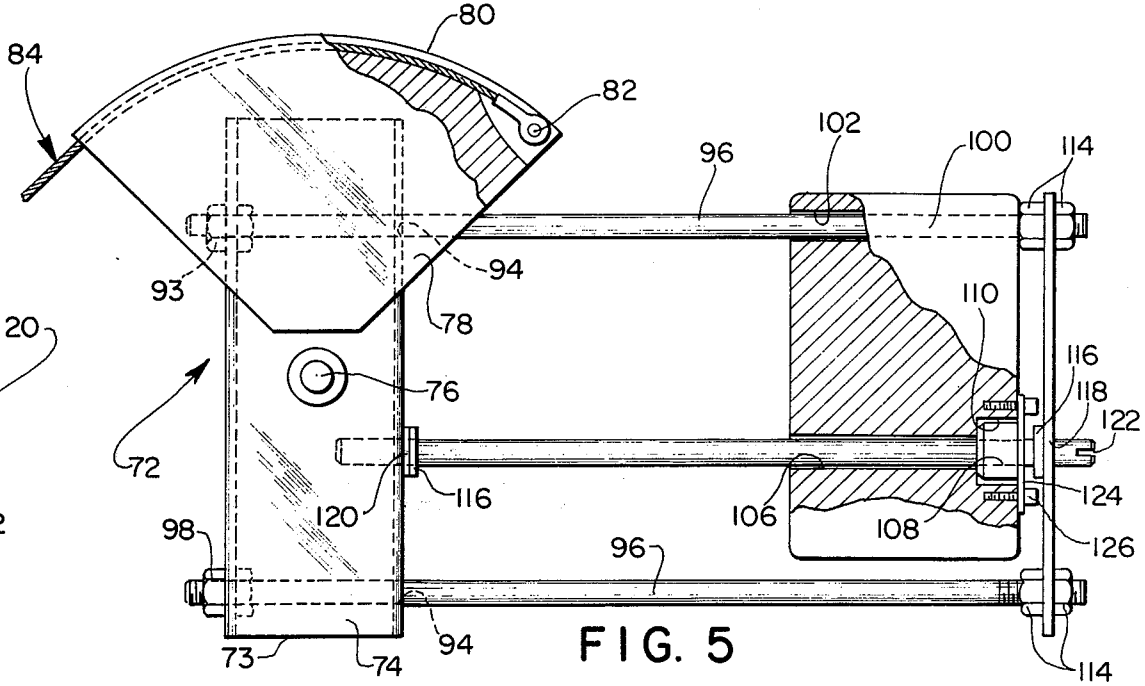
FIG. 5 is an enlarged scale side view with portions broken away for clarity of the differential pressure means of the present apparatus.
Figure 1:
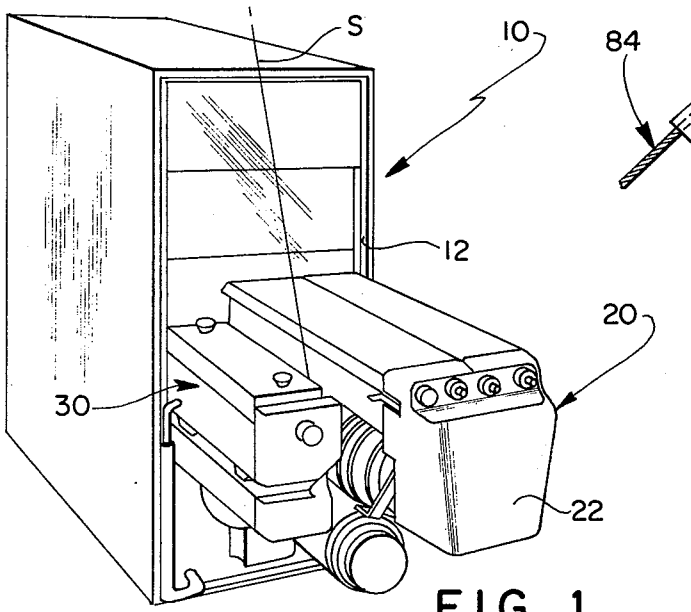
FIG. 1 is a perspective view of a high speed winding apparatus incorporating the present invention.
Figure 4:
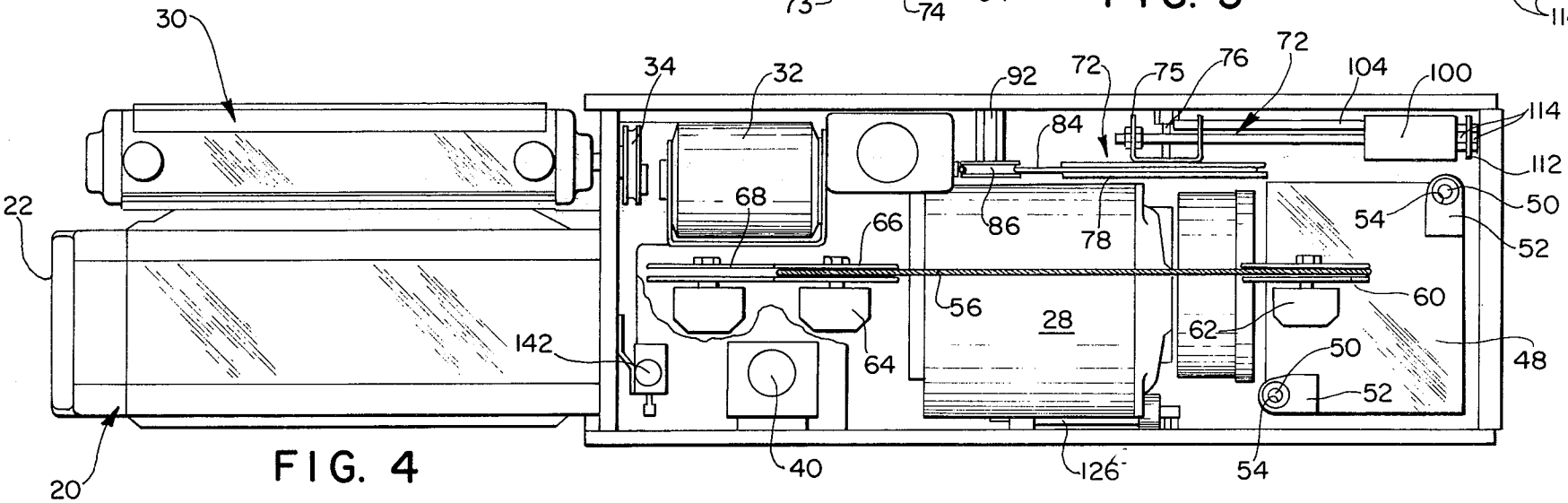
FIG. 4 is a top plan view of the present apparatus in the position shown in FIG. 2 with parts removed for clarity.

As used herein the terms "strand" and "strandular material" are employed in a general sense to include all kinds of strand, either textile or otherwise, and the designation "package" is intended to mean the product of the winding machine, whatever its form.

Referring to the drawings, a textile winding machine 10 commonly referred to as a takeup machine is shown. The winding machine is adapted to wind strandular material S advancing from a source of supply such as a spinerette into a textile package P. The machine 10 includes a frame 12 on which a fixed position spindle 14 is independently mounted for rotation. The spindle 14 is further provided with conventional chuck means (not shown) for engaging a package support 16 upon which the package P is built and adapted to rotate as a unit within bearing means (not shown).

Drive means 20 is mounted above said spindle and includes a housing 22 which supports a rotatable drum or bail member 24 in turn driven by shaft 26 by means of motor 28. The package support 16 while supported by the fixed spindle 14 is driven by means of the rotating drum 24 which engages the periphery of the package support 16, and ultimately with the package P of strand progressively wound thereon, to thereby rotate the same.

The machine further includes traversing means 30 having a barrel cam (not shown) of conventional type which is mounted for rotation and which is provided with an endless helical groove, a follower (not shown) engaged in the groove of the barrel cam and a traverse guide (also not shown) mounted on the outer end thereof which engages the advancing strand S. As the barrel cam is rotated by means of motor 32 through suitable power transmission means 34, the traverse guide reciprocates from reversal point to reversal point of the grooved cam and accordingly serves to distribute the strand S along the package support 16 and package P which is formed thereon.

Both the drive means 20 and the traverse means 30 and their accompanying motors 28 and 32 respectively are mounted on a counterweighted carriage 36 which moves upwardly as the package P being wound on the support 16 progressively increases in diameter, drive roll 24 always bearing directly on the surface of support 16 as upon initiation of winding and upon the strandular material S of the package P being wound thereon after winding has progressed to the point where at least one layer of strand has been wound onto the support 16. The carriage 36 rides up and down on ball bushings 38 mounted on a major vertically orientated shaft 40. The ball bushings 38 in combination serve to vertically align the carriage within the frame 12. A second shaft 42 provided with a single ball bushing 44 is positioned parallel and spaced from the first shaft 40 so as to prevent the carriage 36 from rotating about the vertical axis of the first shaft 40. Both shafts 40 and 42 are suitably affixed to the frame member by conventional mounting blocks 46. Although the second shaft 42 is shown angularly offset from shaft 40 it should be clear that alternate constructions such as two shafts of equal diameter or shafts otherwise disposed within the frame 12 could be alternatively utilized, the essential element being that the carriage 36 is mounted in vertical alignment, is restrained from rotational movement and is permitted to smoothly move up and down in response to the pressure of the strandular material as the package P being wound therefrom increases in diameter and accordingly transmits such pressure by means of the drive drum 24, it being clear that the rotating drive drum 24 is fixed in position with the carriage 36 and its drive means 26 and motor 28 attached directly thereto.

Carriage 36 is counterweighted initially by means of a major weight or series of weights 48 guided within the frame 12 by diagonally opposed rods 50 by means of edge tabs 52 having openings 54 therein for receiving such rods 50. The weight 48 is suspended from a cable 56 by a centrally extending base plate 58 connected to the cable by suitable means (not shown). The cable is trained over a first pulley means including pulley 60 mounted directly to the frame 12 by means of a bracket 62. A similar bracket 64 is also mounted to the frame 12 and supports another pulley 66 also included in said first pulley means and over which the cable 56 is also trained serves to position the running length of the cable to a second pulley means comprising another pulley 68 secured to the carriage 36 and consequently movable therewith. The cable 56 is trained beneath pulley 68 and upwardly to a connection 70 to which the other end thereof is permanently affixed to the frame 12. The cable 56 being of fixed length, serves as the means by which the weight 48 serves to counterbalance the carriage 36 and the elements mounted thereon. It is preferable that, as depicted, a mechanical advantage is introduced into the pulley system by supporting the carriage on a plurality of running strands of cable 56 ie. two in the particular two to one mechanical advantage accomplished in the specific embodiment shown. Alternately pulley systems including three, four or more supporting strand configurations could be utilized, it further being clear that the introduction of such mechanical advantage further serves to reduce the required mass of the weight 48 needed to counterweight the carriage 36 and the elements fixed thereto but increases the distance through which it needs to travel. The driving force between the drive drum 24 and the package P is at least equal to the difference between the counterbalancing effect of the major weight 48 and the total weight of the carriage and the elements supported thereon and may be preset to whatever extent found desirable. Such driving force would of course be constant throughout the package building process. Inasmuch as it has been emperically determined that desirable package characteristics are obtained when the resultant package is wound under a varying driving force which decreases as the package builds it has been found desirable to superimpose upon such constant driving force a varying driving force in the form of differential pressure means 72 which enables the effective weight placed upon the carriage 36 and thus the drive force on the package P, to be reduced as the package builds and the carriage moves upwardly. Such differential pressure means 72 includes a U-shaped bracket 73 having a base 74 and arms 75 pivotally attached to a portion of the frame member 12 by means of a conventional shaft assembly 76. The bracket 73 is further provided with an extension or segment 78 having a peripheral surface 80 defining an arcuate sector. The trailing edge 82 of such extension serves as a connection for a secondary cable 84 trained over the arcuate surface 80 and extending under a pulley 86. Cable 84 has its other end secured to a bracket 88 which is in turn fixed to the carriage 36 by suitable means such as the bolt 90 depicted. The pulley 86 is in turn fixed to the frame 12 by means of the shaft 92.

The bracket 73 is further provided with openings 94 in the arms 75 thereof which rods 96 are affixed by means of nuts 98 so as to extend outwardly therefrom in a generally longitudinal or horizontal orientation. A secondary weight 100 is suspended on at least one of said rods 96 by means of an opening 102 therein so as to form a moment arm. The weight 100 may be laterally adjusted the length of the rod 96 so as to vary the effect of such moment arm by its receipt of a threaded shaft 104 into a smooth bore 106 provided therein. A threaded nut having an elongated configuration threadingly engages the rod 104 and is held from rotation by its receipt in a pocket 110 formed within the weight 100. A plate 112 serves to interconnect the rods 96 and 104. The rods 96 are held thereto by means of nut means 114 whereas the threaded rod 104 is positioned for rotation on bearings 116 through cooperating opening 118 and 120 formed respectively in the plate 112 and in the bracket arm 75 located proximate thereto. It is thus apparent that rotation of the threaded rod 104 by such conventional means as a slotted opening 122 forces the nut 108 restrained from rotation to in turn force the weight 100 inwardly along the moment arm or to the left as shown in FIG. 5 of the drawings. Opposite rotation of the threaded rod 104 transmits such rotational force imparted to the nut 108 against a keeper member 124 held in place to the weight 100 by means of screws 126 and accordingly outwardly moves the weight along the moment arm and to the right as shown in FIG. 5. Adjustment of the moment arm force of the differential pressure means 72 is thus accomplished.

Figure 2:
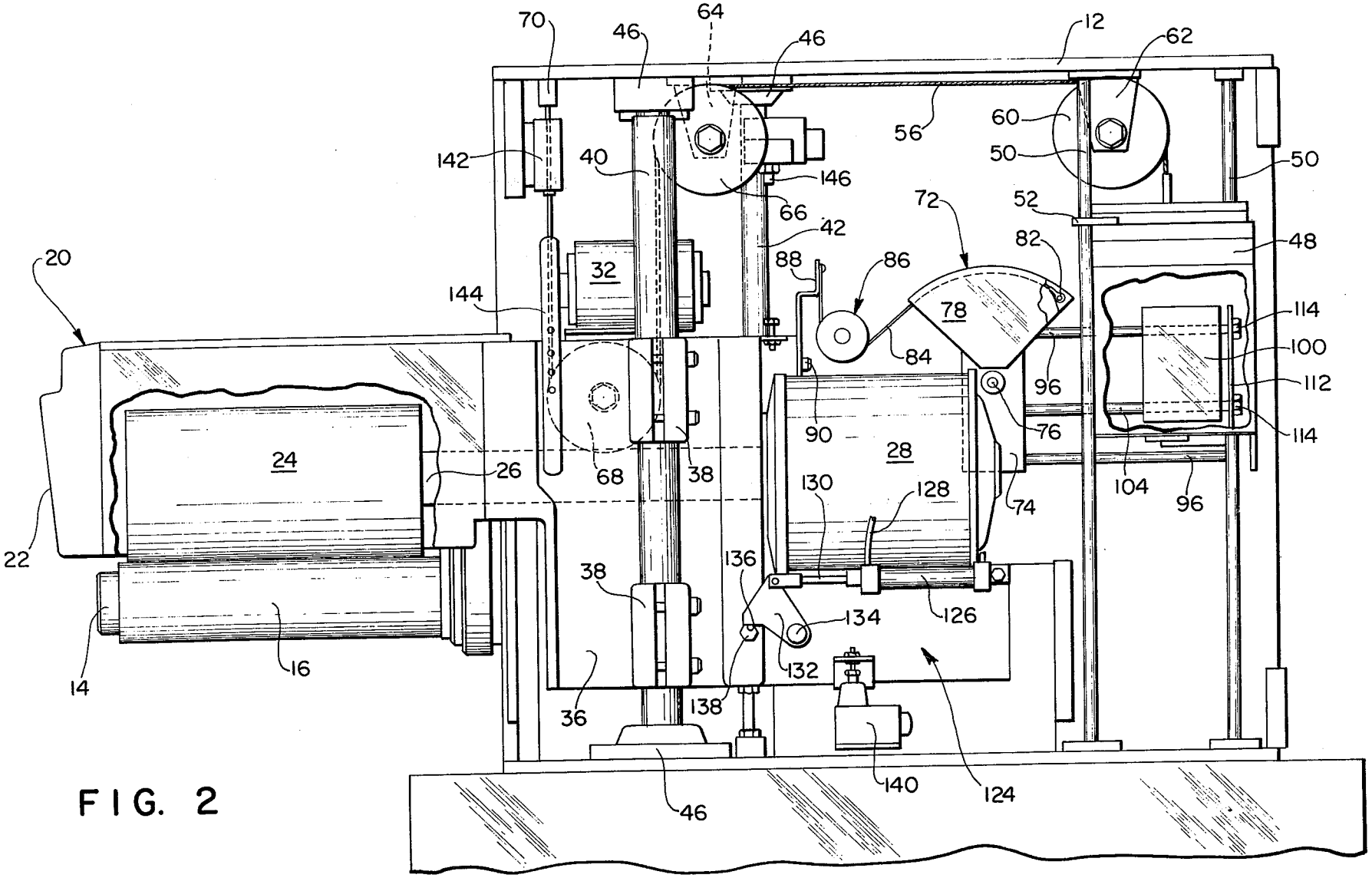
FIG. 2 is a sectional view taken along the line 2—2 of FIG. 1 showing the interrelationship of the apparatus components upon the initiation of strand winding.

It is also apparent that at initiation of package winding as shown in FIG. 2 of the drawings, the added weight effect placed upon the carriage 36 by the differential pressure means 72 is of maximum significance due to the generally horizontal or longitudinal orientation of the moment arm. The weighted moment arm formed by the spaced rods 96 and the weight 100 represents an added driving force to the package P which force is reduced as the moment arm arcuately pivots about the shaft assembly 76 of the bracket 73. It should be further noted that since the cable 84 is trained over an arcuate surface (surface 80), the distance (the radius of segment 78) between the pivot point 76 and the cable 84 remains the same as the trailing edge 82 of the segment 78 moves closer to the pulley 86 and that accordingly, an even, smooth reduction of driving force transmitted from the rotating drum member 24 to the package P is accomplished as the diameter of the package builds and accordingly the carriage 36 moves upwardly so as to arcuately raise weight 100 so that its effect along the moment arm thereof will be diminished to a point approaching zero when the moment arm reaches a vertical position.

In order to reduce the time necessary in which to bring the spindle 14 and the package 16 supported thereon to winding speed from a rest position by means of the rotating drum 24 it has been found particularly helpful to apply an increased amount of pressure or drum force upon the carriage 36 upon initiation of such winding. This reduces skidding that otherwise might occur between the surface of the package support 16 and that of the drum 24 and enables the package support 16 and its underlying chucking structure to reach operative winding speed in a minimum of time. Such increasing pressure is accomplished by means of an initial pressure means 125 including a double acting air cylinder 127 connected to a suitable source of air (not shown) via air lines 128. The air cylinder is in turn provided with a reciprocal piston 130 connected at its forward end to an arm 132 pivotally connected to the frame 12 by means of a pin 134 and having a forward bearing surface for contact with a portion of the carriage 136 in its lowermost position such as the outwardly extending pin 138 shown in the drawings. Upon initiation of the winding cycle a switch 140 serves to activate the piston 130 forwardly thereby engaging the bearing surface 136 of the arm 132 with the pin 138 so as to place an added weight upon the carriage 136. Once the package support 16 reaches operational winding speed and as soon as a layer or several layers of strandular material S have been built thereon, the switch 140 sensing the resultant rise in the carriage 136, initiates a reaction of the piston 134 to remove the added initial force upon the carriage. Alternatively a manually operated switch (not shown) may be utilized to initiate retraction of the piston 134 once the speed of the support 16 has reached winding speed. Also releasing the effect of the temporary pressure means may be accomplished prior to winding any strand S on the support 16 should such strand S be found sensitive to such added winding pressure with either of the alternate actuating systems above described. The carriage is of course not positively held from movement by the initial pressure means 125 but must overcome the air pressure within cylinder 127 in order to permit the rise thereof when layers of strandular material are wound on the package support 16. This accordingly serves to increase the winding pressure initially placed on the first few layers wound on the support 16. Deactivation of the initial pressure means 125 enables the carriage 36 to continue to move upwardly without such additional weight application by the retraction of arm 132 to a position where it clears the bolt extension 138, utilized to contact the arm 132 during the application of such initial pressure means. In addition to the arm 132, the piston 127 and the switch 140 are suitably connected to the frame 12.

As the winding cycle of the package P progresses, its carriage 136 is free to move upwardly immediately as reflected by increased dimensions in the package P. Uneven movement of the carriage in response to package building which would undesirably affect the characteristics of the resultant package due to the tension variations imparted thereto are thus avoided. By providing a differential pressure means as an override to an initial counterbalanced weight and by the application of such combined counterbalancing means to a movable bearing mounted carriage by means of nonslip pulley systems, not only is a package having the desired wrap characteristics produced from a smooth reduction of pressure as the package builds, but the slight variations in the pressure with which the strand is laid upon the package caused by pressure buildup and slippage in piston mounted systems and the delayed response of mechanical linkage supported systems are eliminated.

Figure 3:
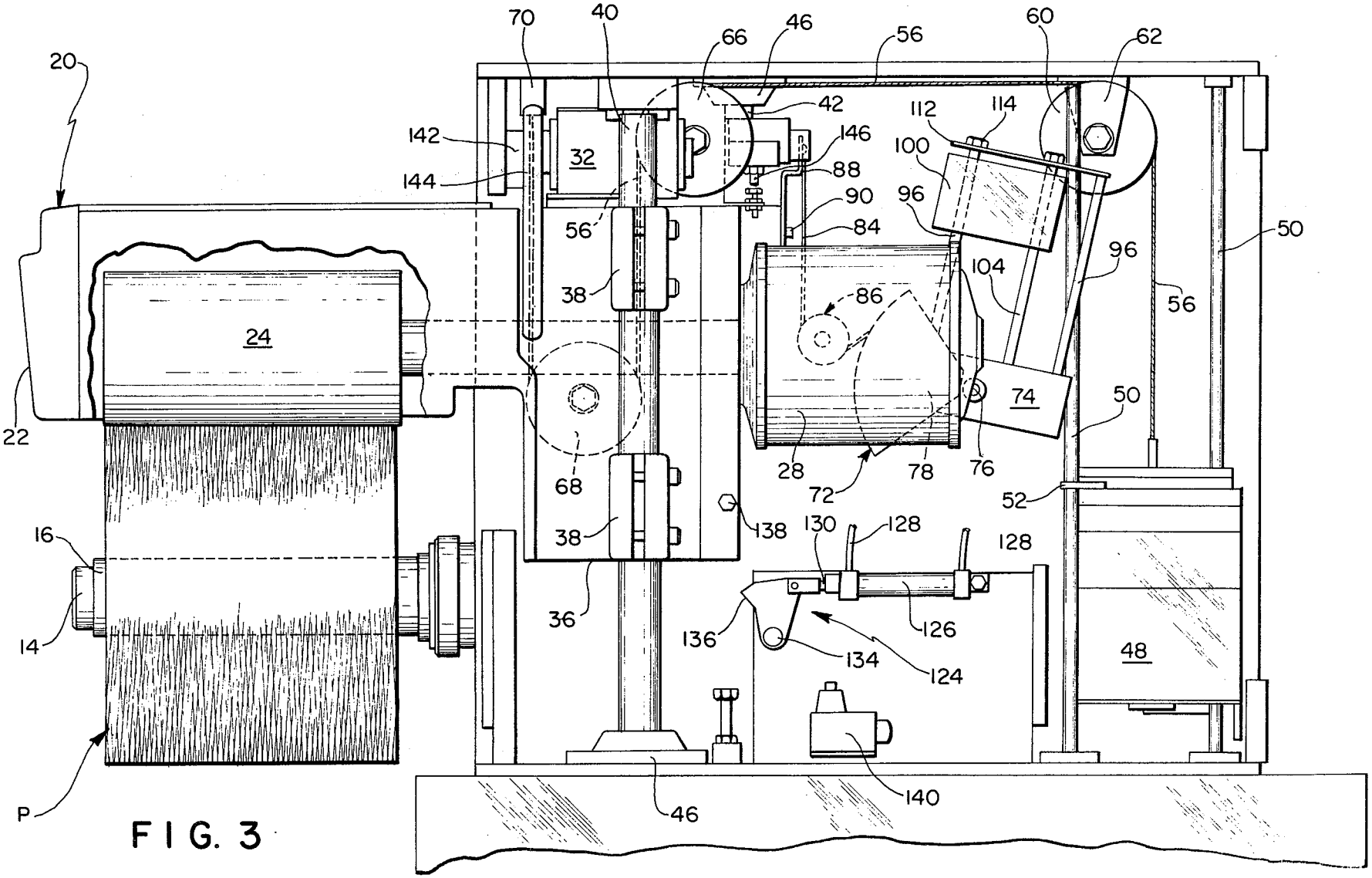
FIG. 3 is a sectional view also taken along the line 2—2 of FIG. 1 and accordingly similar to FIG. 2 of the drawings but showing the interrelationship of the apparatus components approaching completion of package winding.

As best shown by reference to both FIGS. 2 and 3 of the drawings, a limit switch 142 is adapted for interaction with an adjustable contact means 144 so that the drive means of the present winding apparatus is deactivated when the package P exceeds the desired dimension or weight. Also a switch 146 initiates, in sequence, braking, chuck collapsing and package doffing as is known in the art, is provided at a different location for contact with carriage portions should the shutoff switch 142 become inoperative. An operator is then free to remove the completed package and its accompanying support 16 from the spindle 14 and re-initiate winding cycle.

It should be understood that variations and modifications and special adaptations of the embodiments of the present invention may be utilized without departing from the scope of the present invention as set forth in the following claims:

What is claimed is:

1. Apparatus for winding an advanced strand into a package comprising, fixed position take-up means, strand traversing means for guiding said strand to said take-up means, surface drive means for driving said take-up means to wind up the strand into a package thereon, a carriage supported for free vertical movement from an initial lower position at initiation of package winding to an upper terminal position at the completion of winding said package, both said traversing means and said drive means being positioned above said take-up means on said carriage so that said traversing means and said driving means freely move upwardly as the package increases in size, and suspended counterweight means for counter balancing said carriage and said traversing and drive means mounted thereon while affording a constant substantially uniform force urging said package into engagement with said drive means, and differential pressure means for applying a gradually reducing secondary force upon said package as said package increases in size.

2. Apparatus as set forth in claim 1 wherein said carriage is supported on vertical parallel spaced shafts.

3. Apparatus as set forth in claim 2 wherein a first of said shafts acts to align said carriage vertically and a second of said shafts prevents rotation of said carriage about said first shaft.

4. Apparatus as set forth in claim 2 including a frame on which said spindle and said shafts are mounted and wherein said counter weight means is suspended from said frame by means of a cable.

5. Apparatus as set forth in claim 4 including first pulley means mounted on said frame and second pulley means mounted on said carriage, said cable being of fixed length and having one end thereof connected to said weight, said cable sequentially trained over said first pulley means and said second pulley means and having its other end connected to said frame so as to effect a mechanical advantage in such counterweight means.

6. Apparatus as set forth in claim 1 wherein said differential pressure means comprises a movable weighted moment arm, and means connecting said moment arm to said carriage so that upward movement of said carriage moves said moment arm from a generally horizontal attitude to a generally vertical attitude at the terminal position of such carriage.

7. Apparatus as set forth in claim 6 wherein said moment arm includes means for adjustably positioning a secondary weight along said moment arm.

8. Apparatus as set forth in claim 7 wherein said means for adjustably positioning said secondary weight includes a nut engaged with a threaded rod supporting said secondary weight.

9. Apparatus as set forth in claim 6 wherein said moment arm is movable about a pivot point, said pivot point being disposed so that the radial distance between the pivot point and said moment arm remains constant as said moment arm swings from initial to terminal positions.

10. Apparatus as set forth in claim 1 including temporary pressure means for increasing contacting pressure between said drive means and said take-up during initiation of package winding.

11. Apparatus as set forth in claim 10, wherein said temporary pressure means includes means for contacting said carriage at its lower position to apply added weight whereto.

12. Apparatus as set forth in claim 11 including a frame on which said take-up means and said carriage are supported, said means for contacting said carriage including a pivotable arm attached to said frame, and air pressure means for moving said arm into contact with said carriage and for withdrawing said arm from contact with said carriage after said take-up means has reached winding speed.

13. Apparatus as set forth in claim 12 including switch means for sensing upward movement of said carriage and operable to initiate withdrawal of said arm when said package attains a predetermined size.

* * * * *